US009092927B2

(12) United States Patent
Logue

(10) Patent No.: US 9,092,927 B2
(45) Date of Patent: Jul. 28, 2015

(54) MEDICAMENT DISPENSING DEVICE

(75) Inventor: Anthony Thomas Logue, Yowie Bay (AU)

(73) Assignee: LOGUE AND CO. PTY LTD, Yowie Bay NSW (AU)

( * ) Notice: Subject to any disclaimer, the term of this patent is extended or adjusted under 35 U.S.C. 154(b) by 155 days.

(21) Appl. No.: 13/883,467

(22) PCT Filed: Nov. 4, 2011

(86) PCT No.: PCT/AU2011/001419

§ 371 (c)(1), (2), (4) Date: May 3, 2013

(87) PCT Pub. No.: WO2012/065210

PCT Pub. Date: May 24, 2012

(65) Prior Publication Data

US 2013/0221022 A1 Aug. 29, 2013

(30) Foreign Application Priority Data

| | | |
|---|---|---|
| Nov. 17, 2010 | (AU) | 2010905096 |
| Mar. 1, 2011 | (AU) | 2011900706 |
| Aug. 4, 2011 | (AU) | 2011100967 |
| Aug. 4, 2011 | (AU) | 2011903100 |

(51) Int. Cl.

| | |
|---|---|
| ***G07F 11/02*** | (2006.01) |
| ***G07F 11/00*** | (2006.01) |
| ***G07F 11/62*** | (2006.01) |
| ***G07F 17/00*** | (2006.01) |

(52) U.S. Cl.

CPC ..... *G07F 11/02* (2013.01); *G07F 11/00* (2013.01); *G07F 11/62* (2013.01); *G07F 17/0092* (2013.01)

(58) Field of Classification Search

USPC ..... 221/69, 92, 133, 197, 199, 287

See application file for complete search history.

(56) References Cited

U.S. PATENT DOCUMENTS

| | | | | |
|---|---|---|---|---|
| 5,755,357 | A * | 5/1998 | Orkin et al. | 221/82 |
| 6,141,942 | A | 11/2000 | Frederick et al. | |
| 6,814,256 | B2 * | 11/2004 | Clark | 221/79 |

(Continued)

FOREIGN PATENT DOCUMENTS

| | | |
|---|---|---|
| EP | 1382321 | 1/2004 |

OTHER PUBLICATIONS

Australian International-Type Search Report received in Australian Patent Application No. 2010905096 dated Dec. 22, 2010.

(Continued)

*Primary Examiner* — Gene Crawford
*Assistant Examiner* — Kelvin L Randall, Jr.
(74) *Attorney, Agent, or Firm* — Keller Jolley Preece

(57) ABSTRACT

A medicament dispensing device comprises a first compartment, a second compartment and at least one opening accessible by a consumer and adapted to allow the consumer to retrieve a medicament package dispensed from one of the compartments. The first compartment receives and dispenses a corresponding first type of medicament package and has an internal configuration adapted to receive the first type of medicament package. The second compartments receives and dispenses a corresponding second type of medicament package and has an internal configuration that differs from the first compartment and that is adapted to receive the second type of medicament package but not the first type of medicament package.

12 Claims, 17 Drawing Sheets

(56) References Cited

U.S. PATENT DOCUMENTS

| | | | | |
|---|---|---|---|---|
| 6,883,681 | B1 | 4/2005 | Coughlin et al. | |
| 2003/0019879 | A1* | 1/2003 | Hubicki | 221/15 |
| 2003/0062287 | A1 | 4/2003 | Gelardi et al. | |
| 2006/0016717 | A1* | 1/2006 | Ritter | 206/526 |
| 2006/0065670 | A1* | 3/2006 | Doublet et al. | 221/1 |
| 2008/0164272 | A1* | 7/2008 | Dallman | 221/2 |
| 2008/0283435 | A1* | 11/2008 | Morgan | 206/484 |
| 2009/0194434 | A1 | 8/2009 | Ellis et al. | |
| 2009/0272756 | A1* | 11/2009 | Hackney | 221/154 |
| 2012/0217260 | A1* | 8/2012 | Sofranko et al. | 221/70 |
| 2013/0256330 | A1* | 10/2013 | Wang et al. | 221/1 |

OTHER PUBLICATIONS

Australian International-Type Search Report received in Australian Patent Application No. 2011900706 dated Mar. 22, 2011.

* cited by examiner

MEDICAMENT DISPENSING DEVICE

FIELD OF THE INVENTION

The present invention relates to a medicament dispensing device for dispensing medicament packages, such as blister packs, containing vitamins and other tablets/capsules.

BACKGROUND OF THE INVENTION

Vitamin supplements, such as multi-vitamins, and mineral supplements are pharmaceutical preparations that are intended to supplement a person's diet with vitamins, dietary minerals and other nutritional elements that may be lacking in their regular diet. These supplements are typically packaged in bottles or packets containing a bulk supply of a particular supplement product.

Given the vast array of supplement products on the market and each person's differing supplement needs depending on their lifestyle, age, sex and other characteristics, it is typical for a person to require many different supplement products in order to meet all of the diet supplement needs. The supplements also often need to be taken two, three or more times a day.

Consumers of such supplement products are often deterred by the significant expense of purchasing the supplement products in bulk. Those that do purchase the supplement products may forget to take them, may not need a full bottle or packet of supplement products, or may allow the supplement products to go beyond their expiry date.

As a consequence, consumers can get out of the habit of taking supplement products and may stop purchasing supplement products at all.

OBJECT OF THE INVENTION

It is an object of the present invention to substantially overcome or at least ameliorate one or more of the above disadvantages, or to provide a useful alternative.

SUMMARY OF THE INVENTION

In a first aspect, the present invention provides a medicament dispensing device comprising:

- a first compartment for receiving and dispensing a corresponding first type of medicament package, the first compartment having an internal configuration with a shape that corresponds to a peripheral shape of the first type of medicament package;
- a second compartment for receiving and dispensing a corresponding second type of medicament package, the second compartment having an internal configuration with a shape that corresponds to a peripheral shape of the second type of medicament package and that differs from the internal configuration of the first compartment wherein the second compartment is adapted to receive the second type of medicament package but not the first type of medicament package;
- at least one opening accessible by a consumer and adapted to allow the consumer to retrieve a medicament package dispensed from one of the compartments.

In a preferred embodiment, the internal configuration of the first compartment is a loading aperture having a shape that corresponds to a peripheral shape of the first type of medicament package and the internal configuration of the second compartment is a loading aperture having a shape that corresponds to a peripheral shape of the second type of medicament package.

Preferably, the shape of the loading aperture is the cross-sectional shape of each compartment.

Further preferably, the first and second compartments comprise a peripheral wall that is generally rectangular in cross-section and at least one of the first and second compartments includes a key block arranged against the peripheral wall.

In a preferred embodiment, the key block is removable and comprises one of a plurality of key blocks in a key block system, the key block system comprising:

- a plurality of slots provided on the peripheral wall of each compartment;
- tabs provided on each key block, each tab being configured to be received in any one of the slots, enabling the key blocks to be arranged in various positions around the peripheral wall. Preferably, the slots are provided in an insert arranged against the peripheral wall. Further preferably, the slots and tabs are T-shaped in cross-section.

In a preferred embodiment, the medicament packages each have a generally rectangular base panel with a cutout corresponding to the shape and position of the key block in the corresponding compartment.

Optionally, the medicament packages are blister packs enclosed in a box. Alternatively, the medicament packages are blister packs secured to a base panel.

In a second aspect, the present invention provides a medicament dispensing device comprising:

- a first compartment for receiving a corresponding first type of dispenser cartridge containing a plurality of medicament packages, the first compartment and first type of dispenser cartridge having first complementary mating formations that mate when the first type of dispenser cartridge is received in the first compartment;
- a second compartment for receiving a corresponding second type of dispenser cartridge containing a plurality of medicament packages, the second compartment and second type of dispenser cartridge having second complementary mating formations that differ from the first complementary mating formations and that mate when the second type of dispenser cartridge is received in the second compartment;
- at least one opening accessible by a consumer and adapted to allow the consumer to retrieve a medicament package dispensed from one of the dispenser cartridges.

Preferably, the first compartment has a loading aperture having a shape that corresponds to a peripheral shape of a base of the first type of dispenser cartridge and the second compartment has a loading aperture having a shape that corresponds to a peripheral shape of a base of the second type of dispenser cartridge.

Preferably, the shape of the loading aperture is the cross-sectional shape of each compartment.

Further preferably, the first and second compartments each comprise a peripheral wall that is generally rectangular in cross-section and at least one of the first and second compartments includes a key block arranged against the peripheral wall.

In a preferred embodiment, the key block is removable and comprises one of a plurality of key blocks in a key block system, the key block system comprising:

- a plurality of slots provided on the peripheral wall of each chamber;
- tabs provided on each key block, each tab being configured to be received in any one of the slots, enabling the key blocks to be arranged in various positions around the peripheral wall. Preferably, the slots are provided in an insert arranged against the peripheral wall. Further preferably, the slots and tabs are T-shaped in cross-section.

In another preferred embodiment, the first compartment includes a first slot that guides the first type of medicament package within the first compartment and the second compartment includes a second slot that guides the second type of medicament package within the second compartment.

Preferably, the first slot is provided along a wall of the first compartment and in transverse cross-section, the first slot is offset from perpendicular to the wall of the first compartment and the second slot is provided along a wall of the second compartment and in transverse cross-section, the second slot is offset from perpendicular to the wall of the second compartment. Further preferably, the angular offset of the first slot differs in degree to the angular offset of the second slot. Further preferably, the length of the first slot differs to the length of the second slot.

In another preferred embodiment:

the first compartment includes two opposing first slots extending along opposing walls of the first compartment, wherein in transverse cross-section, the first slots are perpendicular to the opposing walls of the first compartment;

the second compartment includes two opposing second slots extending along opposing walls of the second compartment, wherein in transverse cross-section, the second slots are perpendicular to the opposing walls of the second compartment; and the distance between the first slots differs in length to the distance between the second slots.

Preferably, each slot is provided in a removable guide block that is mounted in the respective compartment.

In a preferred embodiment, the first compartment includes a first removable guide block that defines a first cavity, the dimensions of the first cavity being adapted to receive the first type of medicament package; and the second compartment includes a second removable guide block that defines a second cavity, the dimensions of the second cavity differing from the dimensions of the first cavity.

Preferably, each guide block is slidably mounted on a respective bracket arrangement and each bracket arrangement is identical such that different guide blocks are interchangeable between different compartments.

Optionally, the medicament dispensing device further comprises an electronic information display screen on the front of the medicament dispensing device. The medicament dispensing device may also optionally further comprise a disposable cup dispenser and a tap.

In a third aspect, the present invention provides a blister pack assembly comprising:

a blister pack;

a fluid receptacle; and an attachment device comprising a flat base, a clamp member adapted to secure a blister pack in an upright orientation relative to the base and a support member adapted to support the fluid receptacle in an upright orientation relative to the base and adjacent to the blister pack.

In a fourth aspect, the present invention provides a blister pack tab attachment comprising:

a connector adapted to receive and retain an end of a blister pack to attach the tab attachment to the blister pack;

a straight tab section extending from the connector;

an inclined tab section extending at an incline from the straight tab section.

In a preferred embodiment, the connector is a slot adapted to retain the end of a blister pack by interference fit. Further preferably, the connector comprises a pair of resilient, opposing clamp members that clamp the end of a blister pack.

In a fifth aspect, the present invention provides a blister pack cartridge comprising:

a backing sheet having one or more blister compartments;

a base member extending from a bottom end of the backing sheet; and a spacer member extending from the base member, the spacer member being spaced from the backing sheet, wherein the blister pack cartridge is adapted to stand on the base member.

In a preferred embodiment, the blister pack cartridge is assembled from:

a standard blister pack comprising the backing sheet and blister compartments; and a cartridge adaptor comprising the base member and the spacer member and further comprising a connector adapted to receive and retain an end of the standard blister pack to attach the cartridge adaptor to the standard blister pack.

Preferably, the base member is substantially perpendicular to the backing sheet and the spacer member is substantially perpendicular to the base member and substantially parallel to the backing sheet. Further preferably, the base member and spacer member are rectangular plates. Further preferably, the base member and spacer member are faces of a rectangular box.

Alternatively, the base member extends at an acute angle to the backing sheet and the spacer member extends at an acute angle to the base member so that the backing sheet and the spacer member converge as they extend away from the base member.

Preferably, the blister pack cartridge further comprises a fluid receptacle.

In a sixth aspect, the present invention provides a blister pack attachment comprising:

a base member having first and second ends;

a spacer member extending from the first end of the base member; and a connector provided at a second end of the base member, the connector being adapted to receive and retain an end of a blister pack to attach the cartridge adaptor to the blister pack.

In a preferred embodiment, the connector is a slot adapted to retain the end of a blister pack by interference fit. Preferably, the connector comprises a pair of resilient, opposing clamp members that clamp the end of a blister pack.

Preferably, the spacer member is substantially perpendicular to the base member. Further preferably, the base member and spacer member are rectangular plates. Further preferably, the base member and spacer member are faces of a rectangular box.

Alternatively, the spacer member extends at an acute angle to the base member so that when a blister pack is received in the connector, the spacer member converges toward the blister pack as it extends away from the base member.

Preferably, the blister pack attachment further comprises a fluid receptacle.

In a seventh aspect, the present invention provides a dispensing machine having:

a plurality of medicament packages stored in the machine;

a plurality of compartments adapted to store the medicament packages and to deliver one of the medicament packages via an opening accessible to a user to retrieve the medicament package;

a tap and an associated liquid source, wherein the tap is adapted to dispense a quantity of liquid to the user in order to assist swallowing of the medicament by the user.

In a preferred embodiment, the medicament packages are contained within removable cartridges, each cartridge being loaded in one of the compartments, wherein an empty removable cartridge can be replaced by a full removable cartridge to restock the machine.

Preferably, the dispensing machine further comprises a touch screen computer display arranged on a front surface of the dispensing machine, the touch screen computer display being adapted to provide information relating to the medicaments stored in the dispensing machine.

Further preferably, the medicaments are provided in blister packs, each blister pack storing one or more tablets or capsules.

Further preferably, the liquid source is a water tank.

BRIEF DESCRIPTION OF THE DRAWINGS

A preferred embodiment of the invention will now be described by way of specific example with reference to the accompanying drawings, in which.

DETAILED DESCRIPTION OF THE PREFERRED EMBODIMENTS

Figure 1:
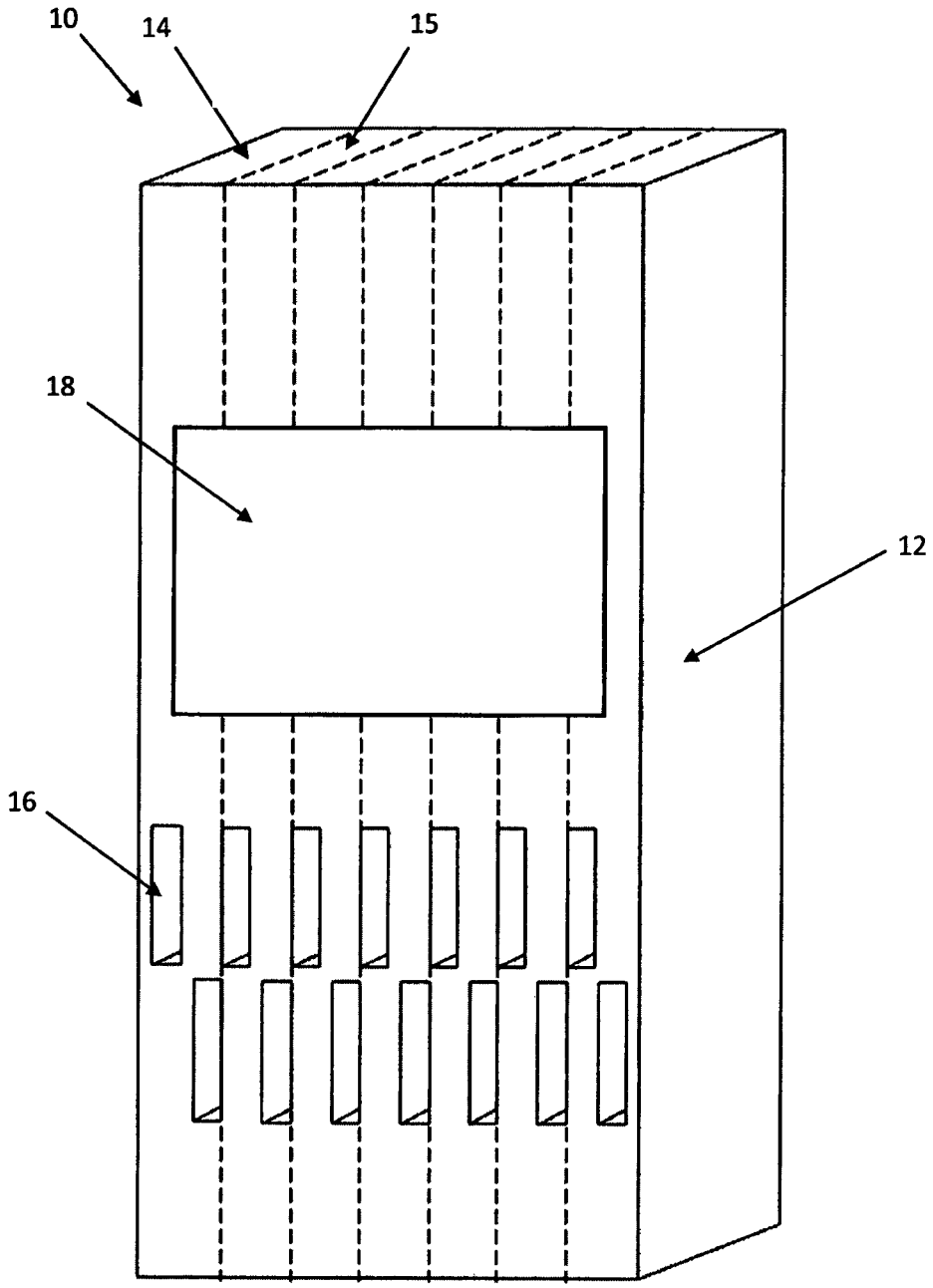
FIG. 1 depicts a medicament dispensing device.

A medicament dispensing device 10 for dispensing medicament packages, is depicted in FIG. 1 and has a main body 12 with a plurality of internal compartments 14.

Each compartment 14 has two openings 16 arranged at the base of the compartment 14. The openings 16 are provided in the front of the main body 12. In alternate embodiments, a single opening 16 is arranged at the base of each compartment 14.

An information screen 18, which is preferably a touch control computer screen, is depicted on the front of the main body 12.

Figure 2:
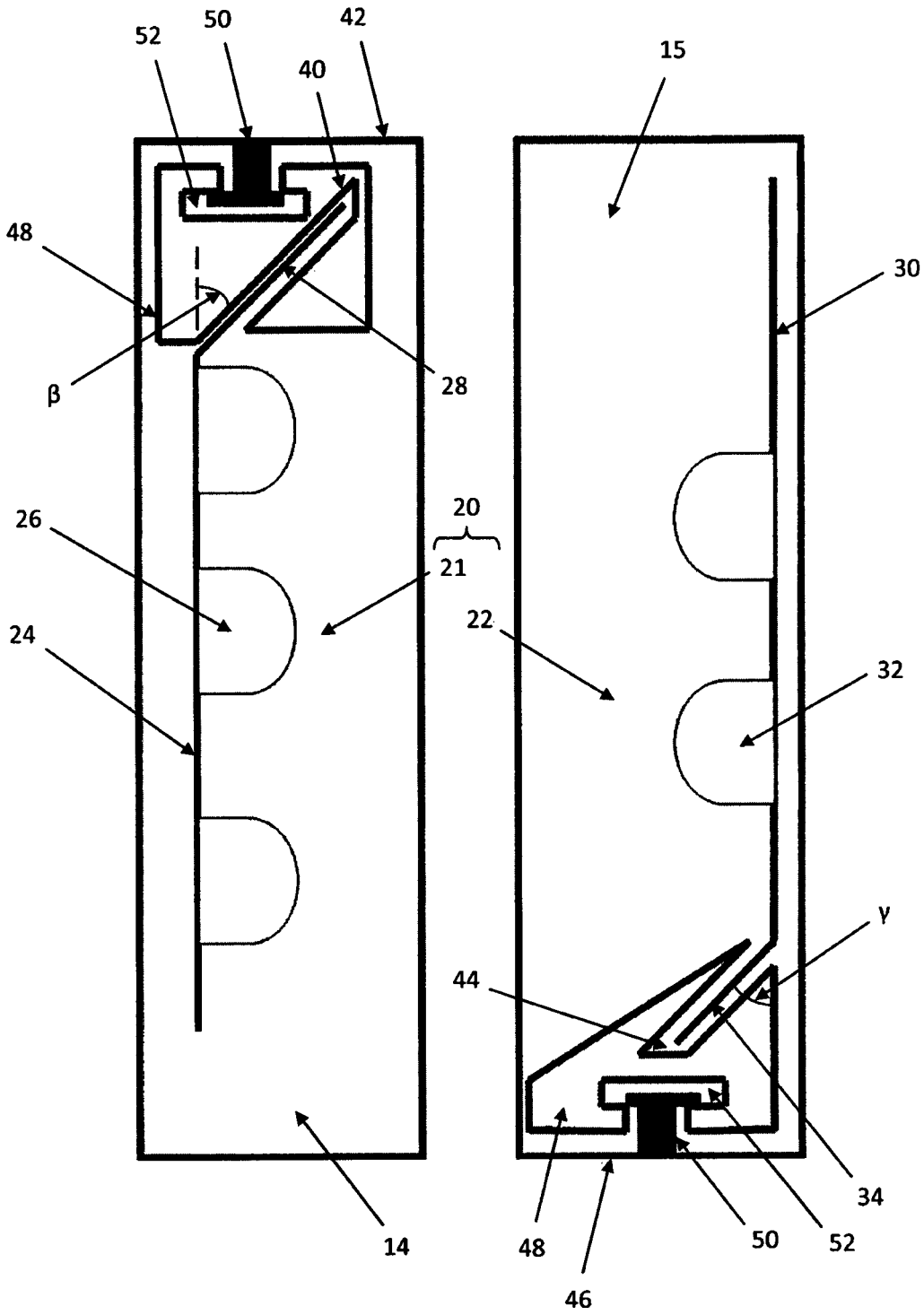
FIG. 2 is a cross section of two compartments of the medicament dispensing device of FIG. 1.

A cross section of a first compartment 14 and a second compartment 15 is depicted in FIG. 2 and shows the arrangement of medicament packages, in the form of blister packs 20, within the compartments 14, 15.

A first blister pack 21 comprises a generally flat base 24, three blister compartments 26 and an inclined tab 28 projecting from an edge of the base 24. The tab 28 has a predetermined length and is inclined to the base 24 by a predetermined angle $\beta$.

A second blister pack 22 comprises a generally flat base 30, two blister compartments 32 and an inclined tab 34 projecting from an edge of the base 30. The tab 34 has a predetermined length and is inclined to the base 30 by a predetermined angle $\gamma$.

A first slot 40 is provided along a wall 42 of the first compartment 14 and a second slot 44 is provided along a wall 46 of the second compartment 15.

The first slot 40 is inclined to the wall 42 of the first compartment 14 by the same angle $\beta$ as the tab 28 of the first blister pack 21, such that when the tab 28 of the first blister pack 20 is arranged in the first slot 40, the base 24 of the first blister pack 21 extends generally perpendicular to the wall 42 of the first compartment 14.

The second slot 44 is inclined to the wall 46 of the second compartment 15 by the same angle $\gamma$ as the tab 34 of the second blister pack 22, such that when the tab 34 of the second blister pack 22 is arranged in the second slot 44, the base 30 of the second blister pack 22 extends generally perpendicular to the wall 46 of the second compartment 15.

As the angle $\beta$ of the first slot 40 and the tab 28 of the first blister pack 21 differs from the angle $\gamma$ of the second slot 44 and the tab 34 of the second blister pack 22, the first blister pack 21 can not be inserted in the second compartment 15 via the second slot 44. Similarly, the second blister pack 22 can not be inserted in the first compartment 14 via the first slot 40. This ensures that each different blister pack 20 can only be inserted into the correctly corresponding compartment 14, 15.

The first and second slots 40, 44 are provided on removable guide blocks 48 that can be interchanged within the compartments 14, 15. The guide blocks 48 are installed on brackets 50 on the walls 42, 46 of the first and second compartments 14, 15. The brackets 50 are T-shaped in cross-section and fit within a corresponding T-shaped groove 52 in the guide blocks 48, so that the guide blocks 48 can be selectively installed, removed and interchanged by sliding the guide blocks 48 along the brackets 50.

As each of the different guide blocks 48 have the same groove 52, different guide blocks 48 can be substituted for one another in order to change the slot configuration in each compartment 14, 15. In this way, each compartment 14, 15 can be selectively configured to receive particular blister packs 20.

Figure 3:
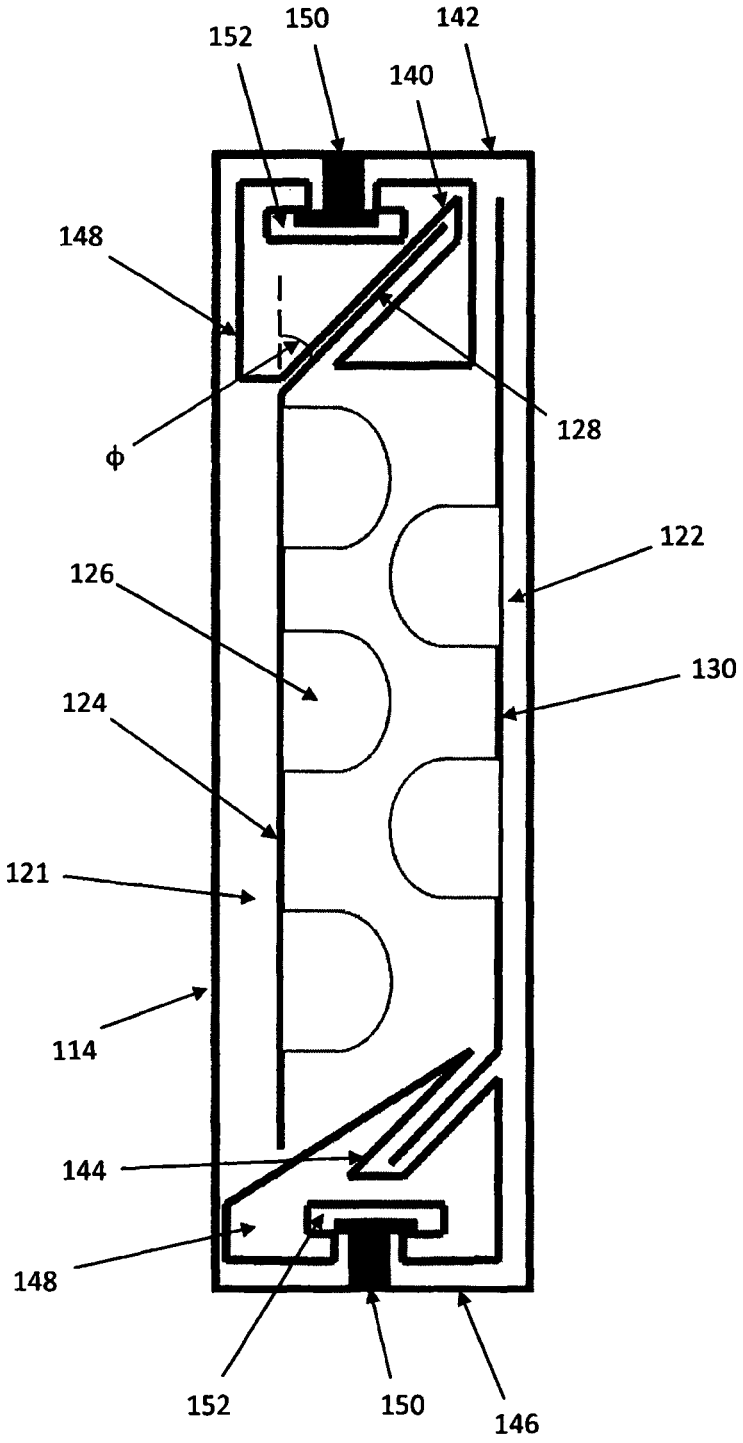
FIG. 3 is a cross section of an alternate compartment.
Figure 4:
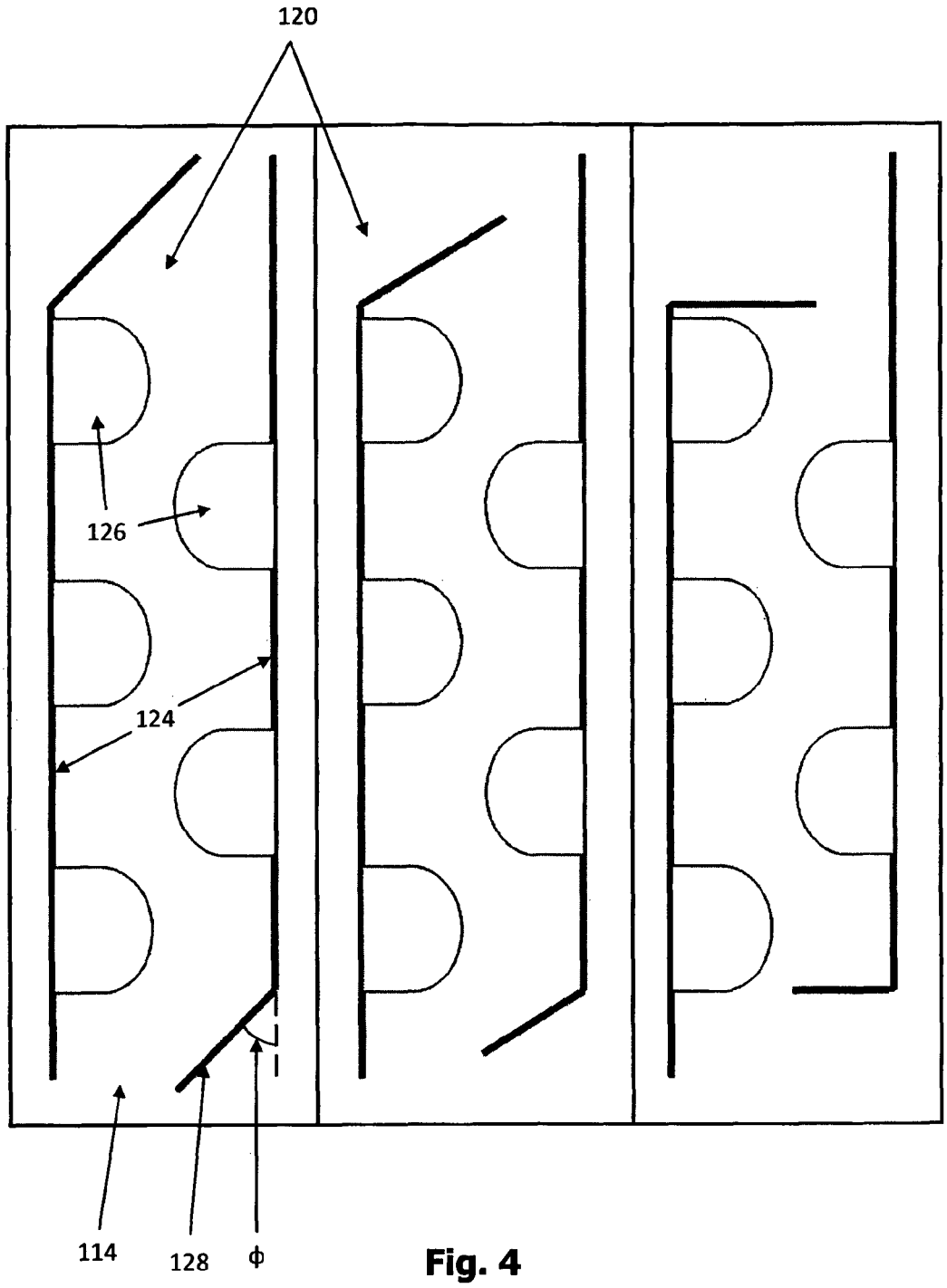
FIG. 4 is a schematic representation of three compartments.

As depicted in FIG. 3 and shown schematically in FIG. 4, two blister packs 120 can be arranged in a single compartment 114 and the blister packs 120 can be arranged in many different combinations with many different designs of blister pack 120. In each blister pack design, the angle $\phi$ at which the tab 128 is inclined to the base 124 and/or the length of the tab 128 is different to each other type of blister pack 20 and is typically an acute angle or an angle of 90°.

Where multiple blister packs 120 are provided in a single compartment 114, the first and second slots 140, 144 are provided on a first wall 142 and a second wall 146 of the compartment 114, respectively.

In this arrangement, the shape of the guide blocks 148 can also be varied to accommodate different lengths of blister pack 120. The blister packs 120 can be provided with predetermined lengths as shown in FIG. 3, in which the base 124 of the first blister pack 121 is shorter than the base 130 of the second blister pack 122. In order to accommodate the length of the first blister pack 121, the guide block 148 on the second wall 146 is tapered. In order to accommodate the length of the second blister pack 122, the guide block 148 on the first wall 142 is truncated.

Figure 5:
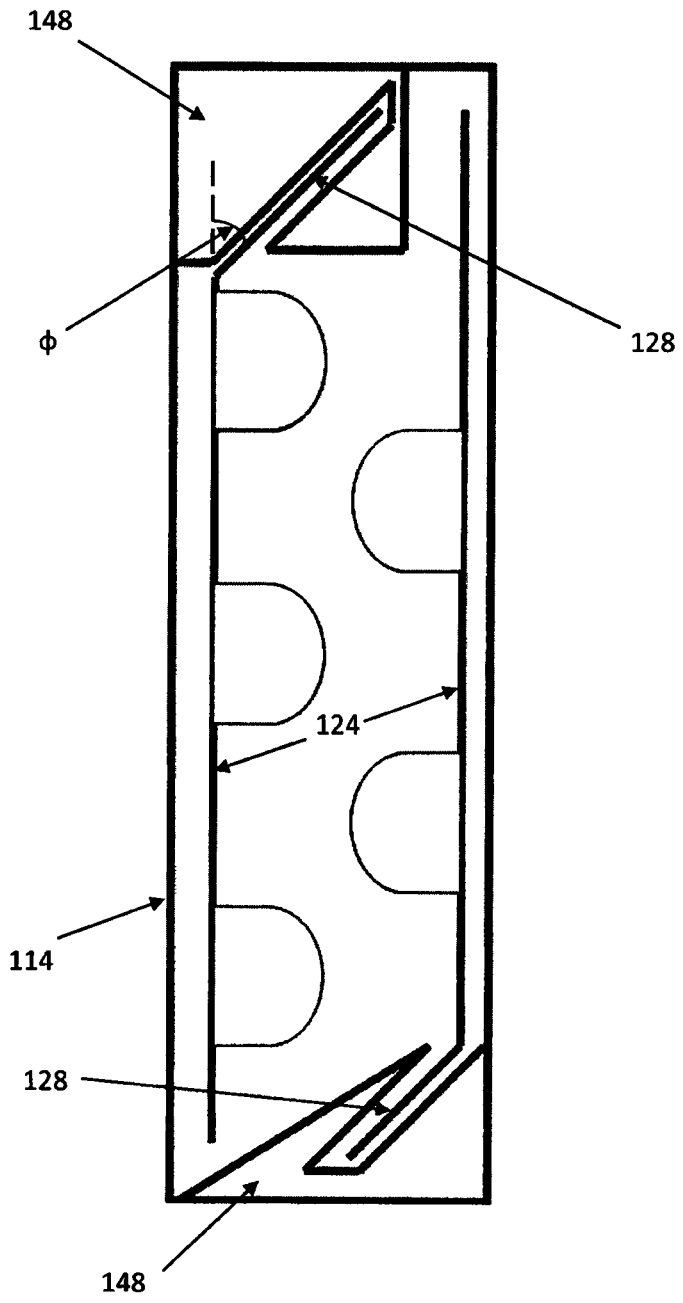
FIG. 5 is a cross section of an alternate compartment.

As shown in FIG. 5, the guide blocks 148 can be integrally formed in the compartment 114 rather than being removable. The tabs 128 will only fit the specific corresponding guide blocks 148 based on their length and angle of inclination $\phi$ to the base 124 as described above.

Figure 6:
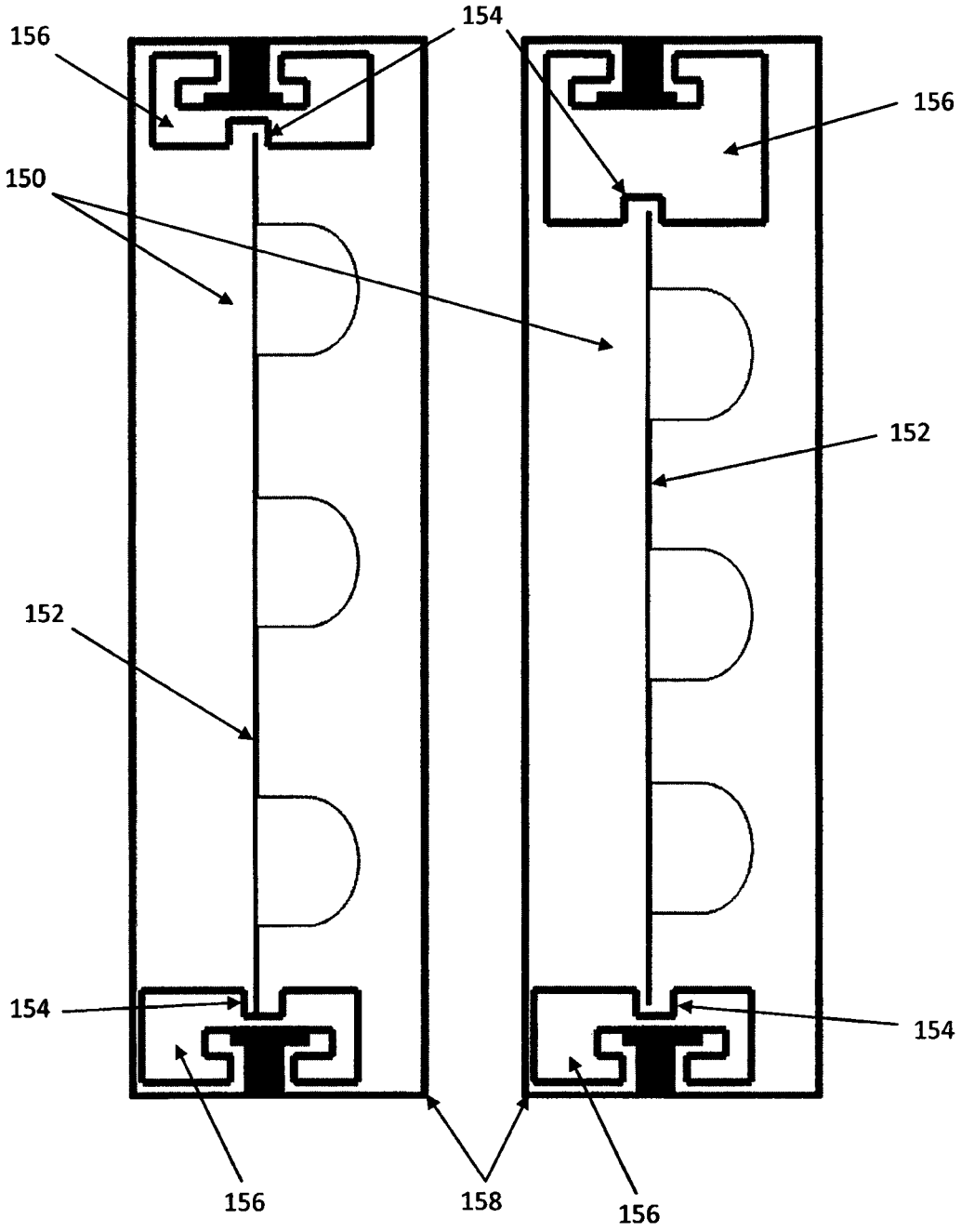
FIG. 6 is a cross section of an alternate compartment.

In another arrangement, shown in FIG. 6, the blister packs 150 do not have an inclined tab. In this arrangement, opposing edges of the base 152 of the blister pack 150 are received in opposing slots 154. The guide blocks 156 in the compartments 158 that provide the slots 154 vary in thickness to accommodate different lengths of blister pack 150.

In this arrangement, differing lengths of the blister packs 150 and corresponding distances between the slots 154 cooperate to allow only the correctly corresponding blister pack 150 to be loaded into the compartment 158.

Figure 7:
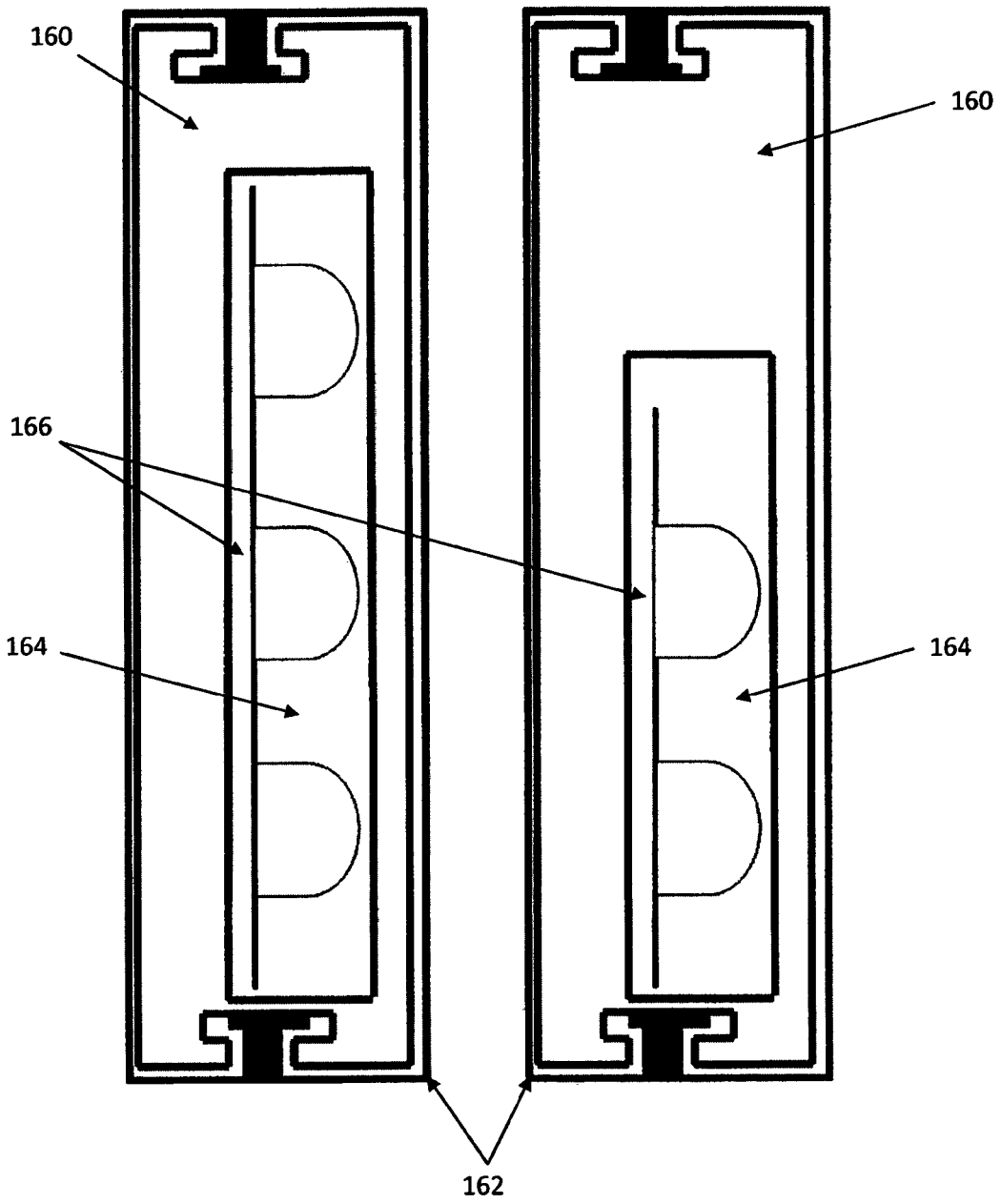
FIG. 7 is a cross section of an alternate compartment.

In another arrangement, shown in FIG. 7, a single guide block 160 is arranged in the compartment 162 and defines a cavity 164 that is sized to receive a blister pack 166 having a specific length.

Similarly in this arrangement, differing lengths of the blister packs 166 and corresponding sizes of the cavities 164 cooperate to allow only the correctly corresponding blister pack 166 to be loaded into the compartment 162.

Figure 8:
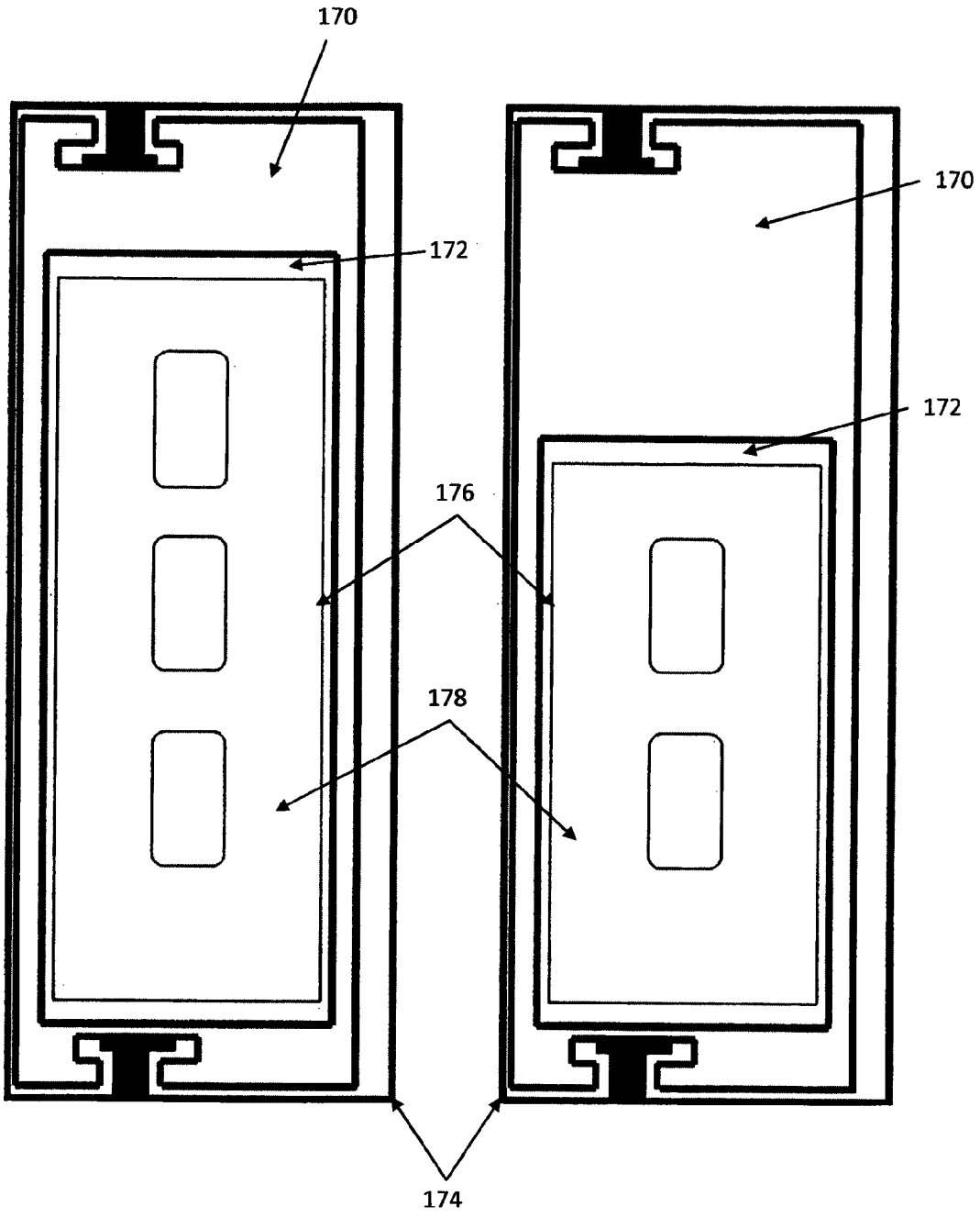
FIG. 8 is a cross section of an alternate compartment.

In another arrangement, shown in FIG. 8, the guide block 170 defines a cavity 172 within the compartment 174 that is sized to receive blister packs 176 stacked with the base 178 arranged horizontally rather than vertically as in the other arrangements above.

In this arrangement, differing lengths and widths of the blister packs 176 and corresponding lengths and widths of the cavities 172 cooperate to allow only the correctly corresponding blister pack 176 to be loaded into the compartment 174.

Figure 9:
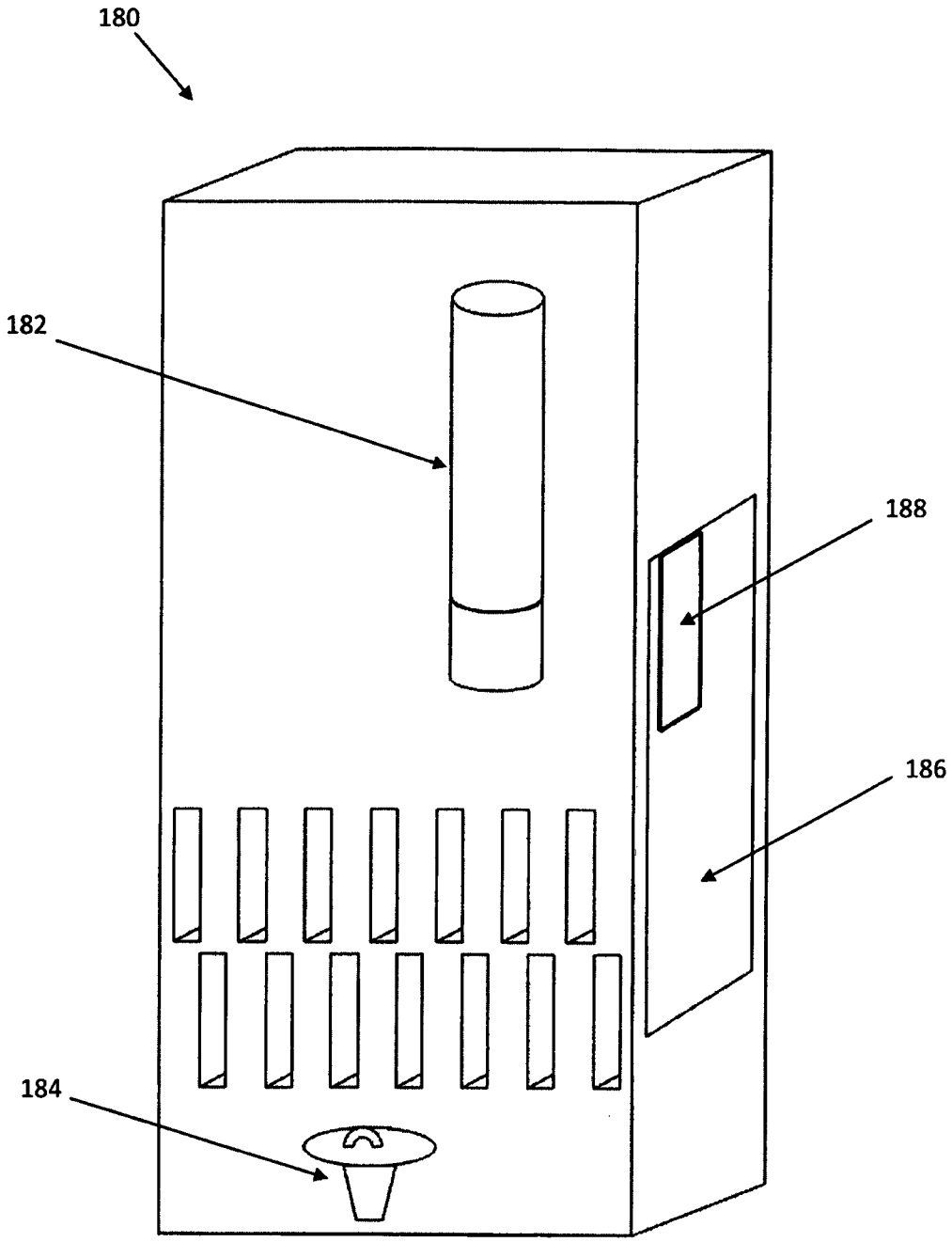
FIG. 9 depicts an alternate medicament dispensing device.

As depicted in FIG. 9, the medicament dispensing device 180 can be provided with a disposable cup dispenser 182 and a tap 184 for providing water for use in consuming the supplements from a medicament package. A water supply may be plumbed directly into the medicament dispensing device 180 or a replaceable water tank may be provided to supply water to the tap 184.

As also depicted in FIG. 9, the medicament dispensing device 180 may have a display 186 providing short form medicament package information cards 188 that can be taken by a consumer together with the medicament package to provide consumer information relating to the supplements contained in each medicament package.

Figure 10:
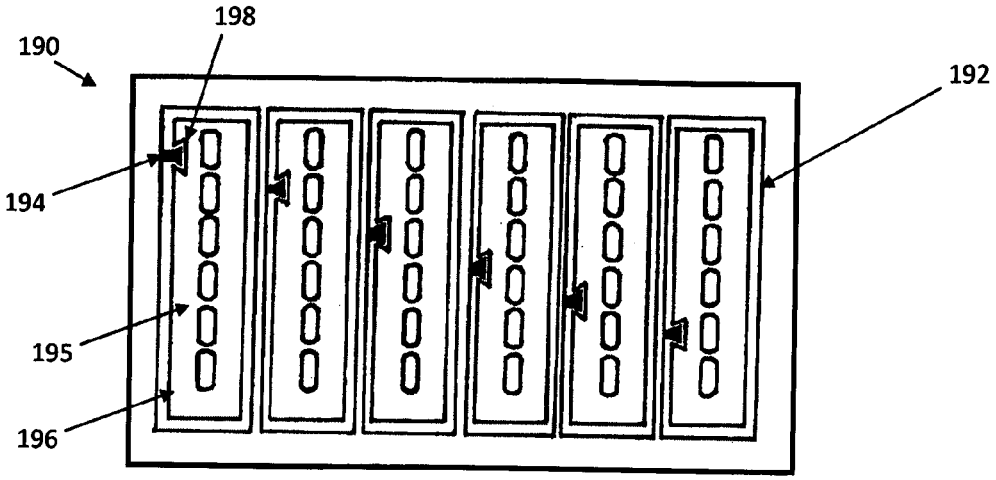
FIG. 10 is a cross section of a medicament dispensing device.

In another arrangement, shown in FIG. 10, the medicament dispensing device 190 has compartments 192 provided with keys 194 and the medicament packages 196 are provided with corresponding keyways 198, shown in this embodiment as a cutout in the base 195 of the medicament package 196.

In this arrangement, the position of the keyway 198 on the medicament package 196 ensures that medicament packages 196 can only be inserted into compartments 192 having the corresponding key 194 preventing the medicament package 196 from being inserted into the wrong compartment 192.

Figure 11:
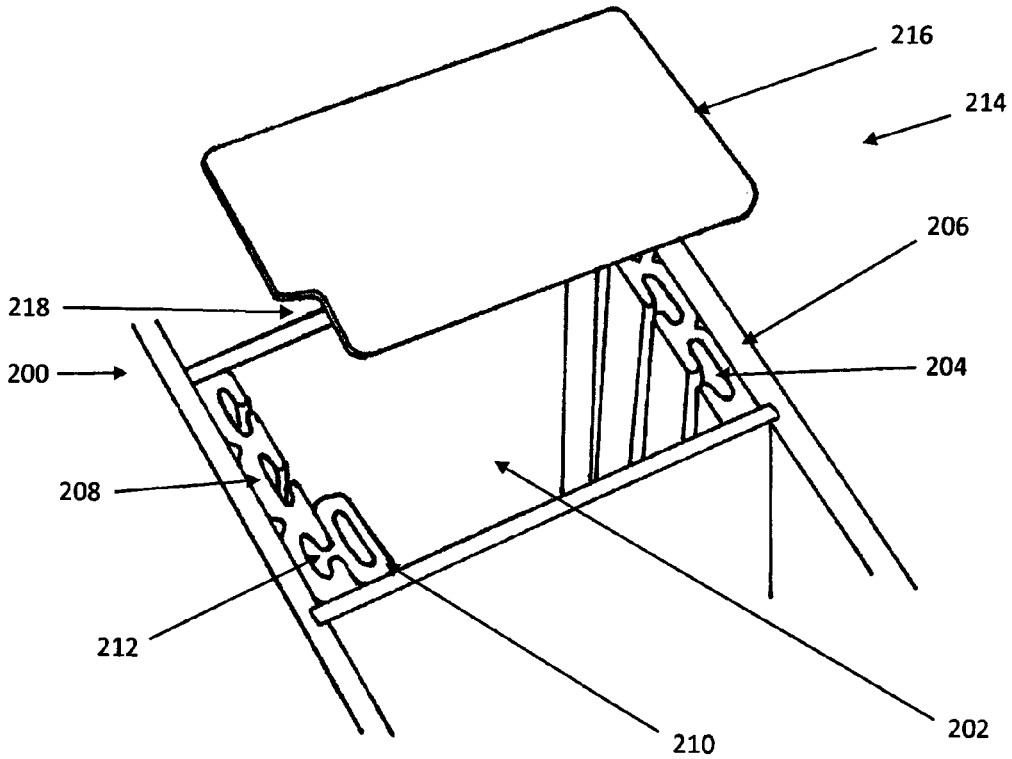
FIG. 11 is a partial view of a medicament dispensing device.

In an alternative embodiment, shown in FIG. 11, the medicament dispensing device 200 includes compartments 202 having a plurality of slots 204 provided on end walls 206 of the compartments 202. In the embodiment shown, the slots 204 are provided by way of an insert 208. A removable key block 210, having a tab 212 corresponding in cross-section to the slots 204, is shown mounted in the compartment 202. In order to mount the key block 210 in the compartment 202, the tab 212 is axially aligned with any of the slots 204 and the key block 210 slides into place in the compartment 202. In this way, the key block 210 can be arranged in any of the six slot 204 locations provided on the end walls 206 of the compartment 202. Multiple key blocks 210 can be inserted in a single compartment 202.

Medicament packages 214 are designed to stack flat within the compartment 202 and are provided with a base panel 216 sized to correspond to the shape of the compartment 202. In the embodiment shown, the base panel 216 has a keyway cutout 218 on one corner corresponding to the position of the key block 210 in the compartment 202.

By arranging key blocks 210 in different configurations within different compartments 202 of the medicament dispensing device 200 and providing different medicament packages 214 with base panels 216 corresponding to each configuration, a system is provided in which only a corresponding medicament package 214 can be loaded into a given compartment 202.

In the embodiment shown, the medicament package 214 comprises the base panel 216 and a blister pack (not shown), which is secured to the underside of the base panel 216. Alternatively, the medicament package 214 could be provided in any of various forms including a box, a sachet attached to a base panel 216, a blister pack with a keyway cutout in the base.

In order to provide an endless number of different configurations for the key and keyway arrangement, a range of key blocks could be provided with various different shapes instead of the generally rectangular key block depicted. By providing different shaped key blocks in different compartments, as well as in different configurations, the number of different configurations (and hence, the number of individually shaped compartments) is limitless.

In an alternative embodiment to that shown, the slots may be provided in the walls of the compartments rather than by way of a removable insert. Further alternatively, the key blocks may be integrally formed in the compartment or fixed in the compartments by other means. In another alternative, keys may be provided on the medicament package and keyways provided in the walls of the compartments. In other embodiments, the width and length dimensions of the compartments and the corresponding medicament packages can be varied to provide a further geometric variable in addition to the key and keyway system.

Figure 12:
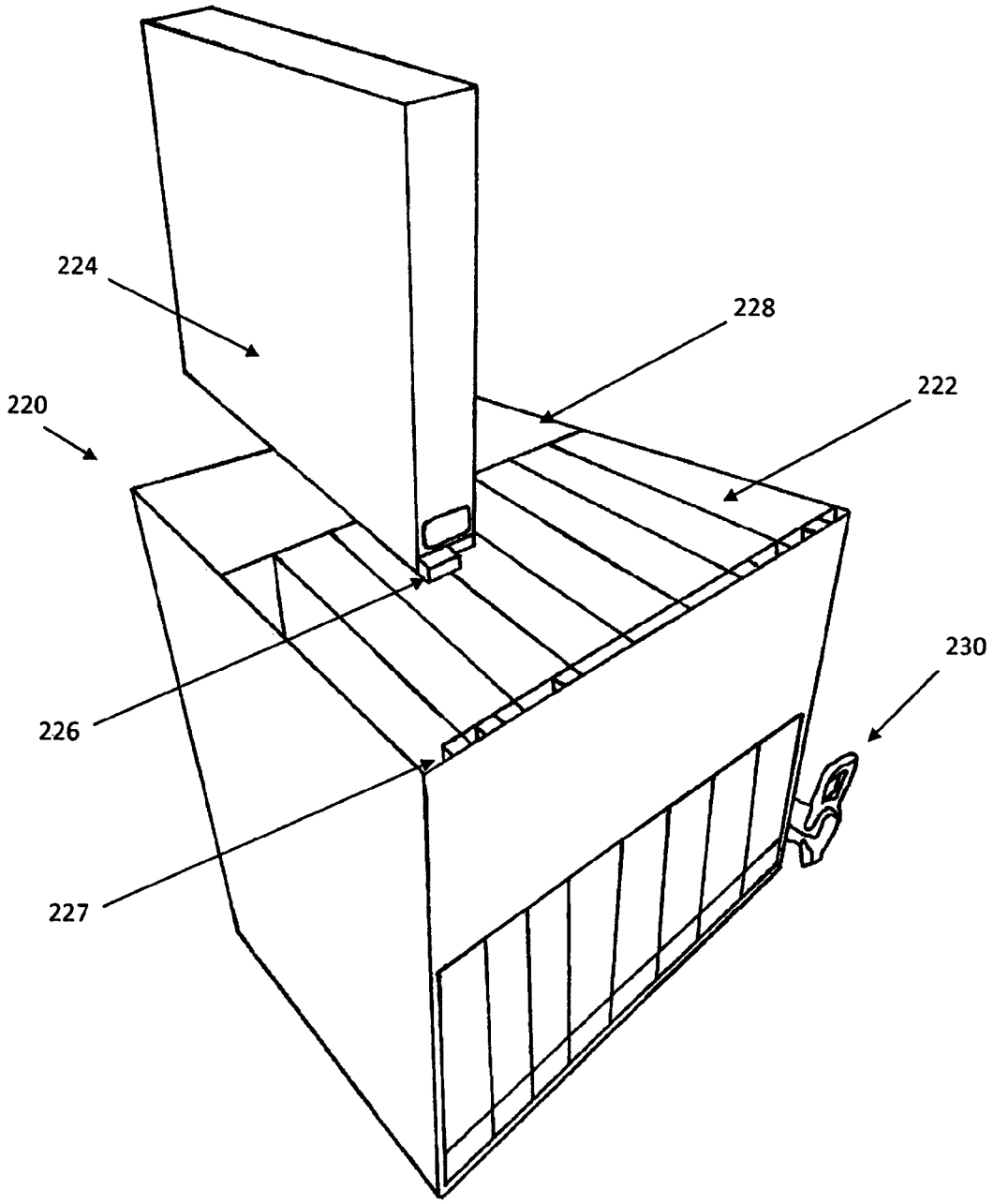
FIG. 12 depicts an alternate medicament dispensing device.

An alternative embodiment is depicted in FIG. 12. In this embodiment, the medicament dispensing device 220 has a plurality of compartments 222 that are each adapted to receive different cartridges 224, each containing a plurality of medicament packages. The cartridges 224 are supplied prepacked with medicament packages, which avoids the need to refill the compartments 222 with individual medicament packages.

In order to ensure that the cartridges 224 are placed in the appropriate compartments 222, the compartments 222 and corresponding dispenser cartridges 224 have complementary mating formations 226, 227 and different compartments 222 have different mating formations 227 such that each dispenser cartridge 224 can only be successfully loaded into the corresponding compartment 222 with a complementary mating formation 226, 227. A key and keyway system similar to that described above may be used to provide the mating formations. The cartridges 224 are provided with a unique mating formation 226 which corresponds to a mating formation 227 provided on a wall of the corresponding compartment 222.

Similar to the embodiment depicted in FIG. 9, the medicament dispensing device 220 depicted in FIG. 12 includes a water tank 228 and a tap 230 for delivering water to a user to assist in the consumption of the medicaments.

Figure 13:
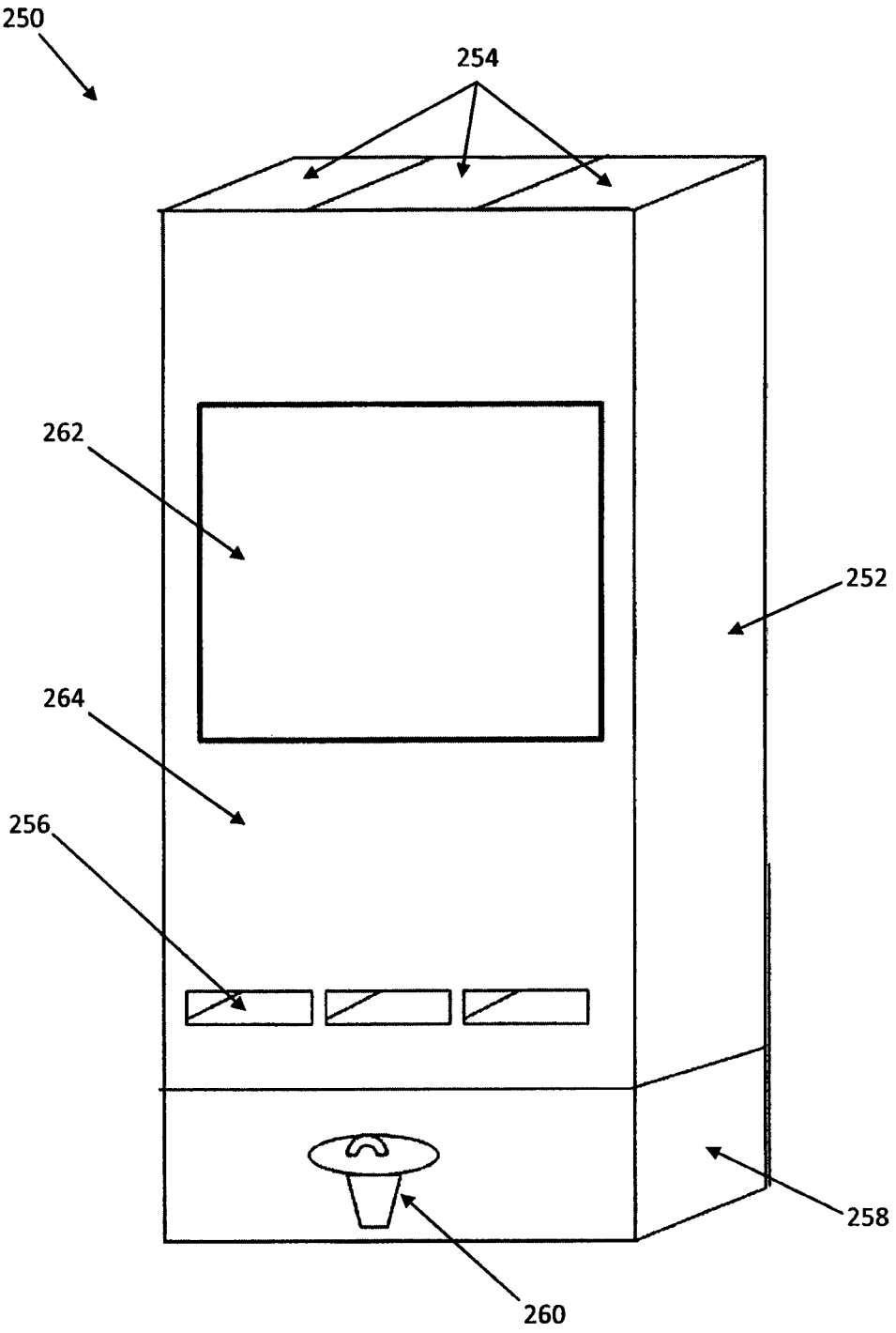
FIG. 13 depicts an alternate medicament dispensing device.
Figure 14:
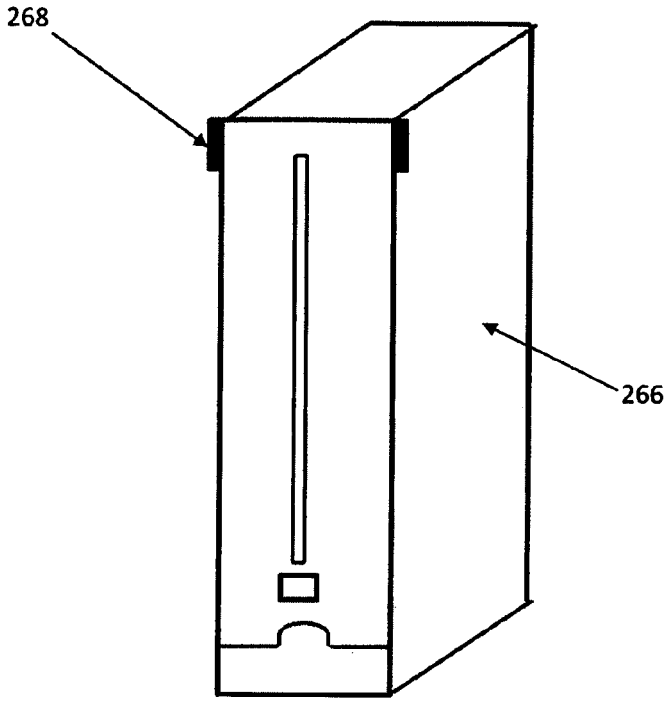
FIG. 14 depicts a removable cartridge of the dispensing device of FIG. 13.
Figure 15:
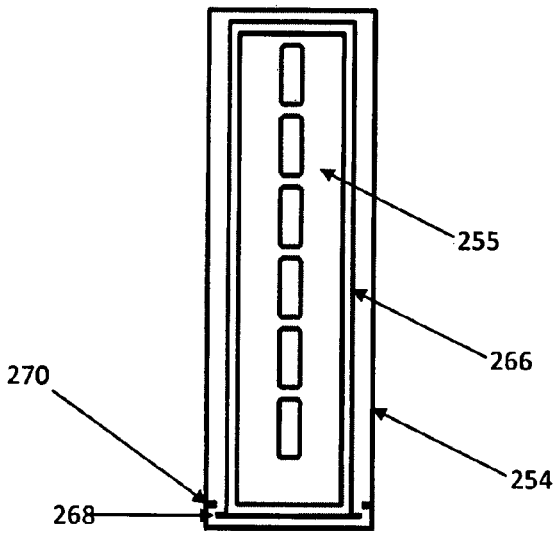
FIG. 15 is a cross-section of a compartment of the dispensing device of FIG. 13 with the removable cartridge of FIG. 14.

An alternative embodiment is shown in FIGS. 13 to 15. The medicament dispensing device 250 comprises a main body 252 for storing a plurality of medicament packages 255, such as blister packs. Within the main body 252, a plurality of compartments 254 are provided. The embodiment depicted includes three compartments 254, however other embodiments may have more or less compartments. Associated with each compartment 254 is an opening 256 provided at the base of the associated compartment 254.

The dispensing device 250 further includes a liquid source, depicted in this embodiment as a water tank 258, and a tap 260 associated with the water tank 258 arranged within the main body 252. A disposable cup dispenser (not shown) is provided either on or near the dispensing device 250.

An interactive touch screen computer display 262 is arranged in or on the front surface 264 of the main body 252. The interactive display 262 is able to receive touch commands from the user to query or purchase a medicament package 255. In response to a query command, the interactive display 262 provides information on the medicaments. In response to a purchase command, the medicament package 255 is delivered from one of the compartments 254 to the associated opening 256 for the user to retrieve.

As depicted in FIGS. 14 and 15, each compartment 254 includes a removable cartridge 266 containing the medicament packages 255. The removable cartridges 266 are adapted to deliver the medicament packages 255 to the associated opening 256 as required and once spent, an empty removable cartridge 266 can be replaced with a fully loaded removable cartridge 266. The removable cartridges 266 are provided with opposing lateral tabs 268 and each compartment 254 is provided with opposing ridges 270. In order to load a removable cartridge 266 into the respective compartment 254, the removable cartridge 266 is inserted in the compartment 254 with each tab 268 being retained between a respective ridge 270 and a wall of the compartment 254. This arrangement retains the removable cartridge 266 in the compartment 254.

In use, a user selects a medicament package 255 on the interactive display 262 and makes the appropriate payment. Payment would typically be made by cash, credit/debit card or mobile phone. The selected medicament package 255 is then delivered from the respective compartment 254 to the associated opening 256 for the user to retrieve. The user then takes a disposable cup and fills it with water from the tap 260. The user is then able to consume the medicament using the cup of water to assist swallowing the medicament.

The medicaments offered in the dispensing device 250 are typically vitamins and other dietary supplements provided in a blister pack. Multiple tablets or capsules may be provided in a single blister pack.

The medicament packages 255 may be stored individually in the compartments 254 in a vertical stack, rather than in a cartridge. Alternatively, the medicament packages 255 may be stored in a separate storage container within the main body 252 and delivered to a common opening.

The tap 260 may be connected via a hose or pipe directly to a water supply rather than the water tank 258 depicted in FIG. 13.

Figure 16:
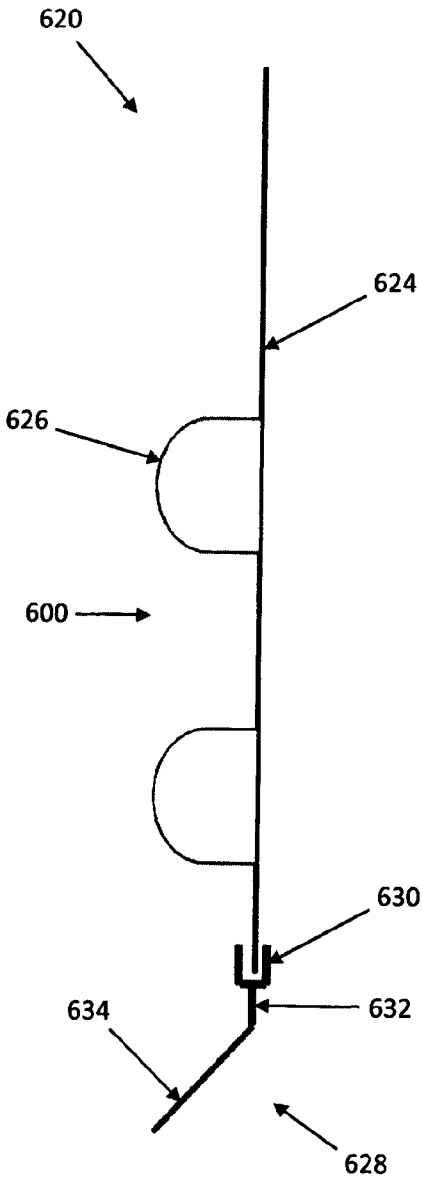
FIG. 16 depicts an alternate embodiment of a blister pack for use in a medicament dispensing device.
Figure 17:
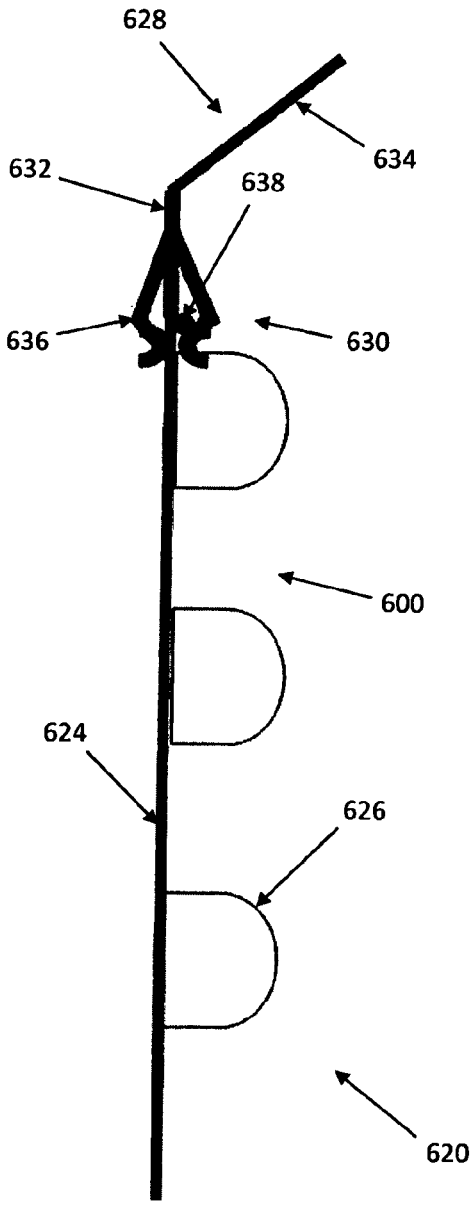
FIG. 17 depicts an alternate embodiment of a blister pack for use in a medicament dispensing device.

In an alternative embodiment, a blister pack assembly 620 is employed, as depicted in FIGS. 16 and 17. The blister pack assembly 620 is the assembly of two components. The first component is a standard blister pack 600 with a flat backing sheet 624 and blister compartments 626. Attached to one end of the backing sheet 624 is a second component, being a blister pack tab attachment 628 that includes a connector 630, depicted in FIG. 16 as a slot, for connecting to an end of the backing sheet 624, a straight tab section 632 extending from the connector 630 and an inclined tab section 634 extending at an incline from the straight tab section 632. The connector 630 is adapted to receive and retain an end of the standard blister pack 600 by interference fit to attach the tab attachment 628 to the blister pack 600.

Once assembled, the blister pack assembly 620 can be used in the same way as described above in the blister pack dispenser 10 of FIG. 1. By providing a tab attachment 628, the different types of blister pack 20 used in the blister pack dispenser 10 can be assembled from a standard blister pack 600 and the tab attachment 628. This avoids the need to manufacture multiple different types of blister pack 20, as all of the different types of blister pack 20 required can be assembled from a number of standard blister packs 600 and different tab attachments 628.

As shown in more detail in FIG. 17, an alternative embodiment of the connector 630 is a pair of resilient, opposing clamp members 636 that are adapted to clamp onto one end of the backing sheet 624 of the blister pack 600. In order to assist in maintaining the tab attachment 628 on the blister pack 600, a rib 638 can be provided on the backing sheet 624 to make removal of the blister pack 600 from the connector 630 more difficult.

The blister pack dispenser 10 provides a convenient outlet for obtaining single dose blister packs 20 of vitamin and mineral supplements that a person may require. It allows consumers to make individual dose purchases rather than buying a bulk amount of the supplements. It is convenient for consumers of supplements who forget to take a dose of supplements and are not able to access their bulk supply of the supplements.

The blister pack dispenser 10 also prevents incorrect loading of blister packs 20 in the compartments 14 by allowing only specifically configured blister packs 20 to be loaded into each compartment 14.

Figure 18:
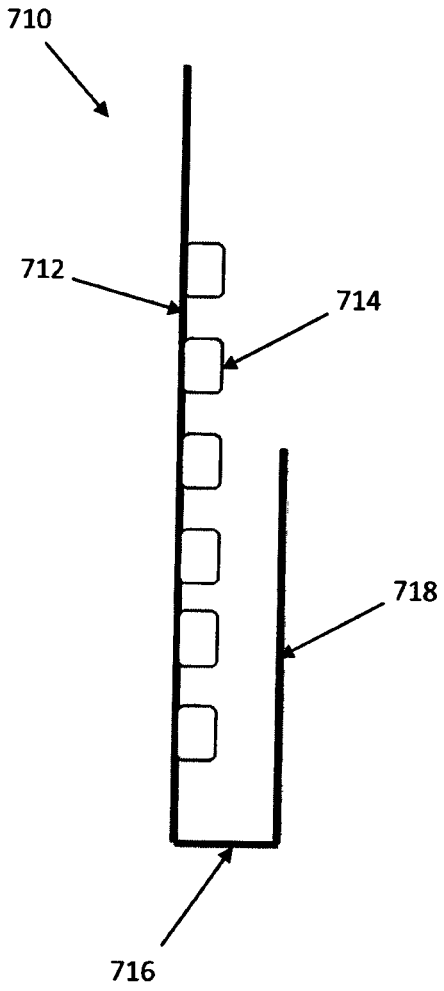
FIG. 18 depicts a blister pack cartridge for a vending machine.

A blister pack cartridge 710 for a standard spiral vending machine is depicted in FIG. 18. The cartridge 710 has a backing sheet 712, a plurality of blister compartments 714, a base member 716 extending perpendicular to the backing sheet 712 and a spacer member 718 extending perpendicular to the base member 716 and parallel to the backing sheet 712. The blister pack cartridge 710 is designed to stand on the base member 716 in between the spiral dividers of a standard spiral vending machine. Accordingly, a standard vending machine can be used to dispense the blister pack cartridges 710.

Figure 19:
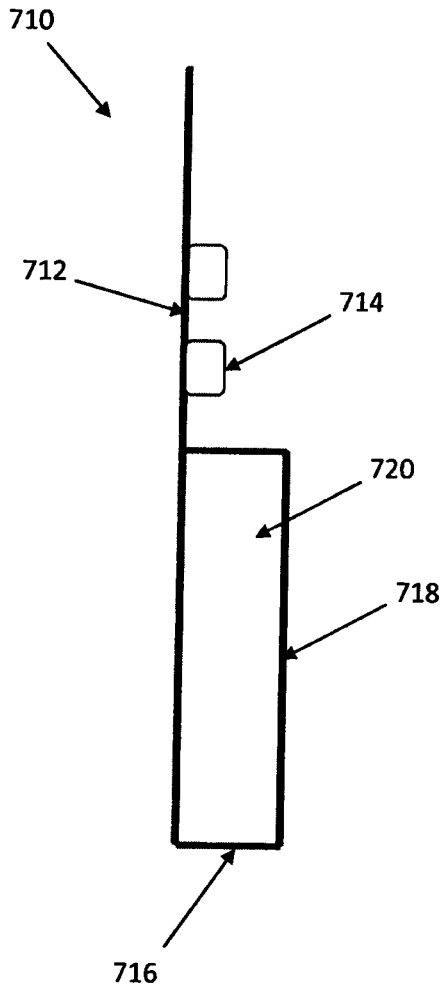
FIG. 19 depicts another embodiment of a blister pack cartridge.

As depicted in FIG. 19, the blister pack cartridge 710 can have a base member 716 and spacer member 718 provided by a box or block 720 secured to the backing sheet 712.

Figure 20:
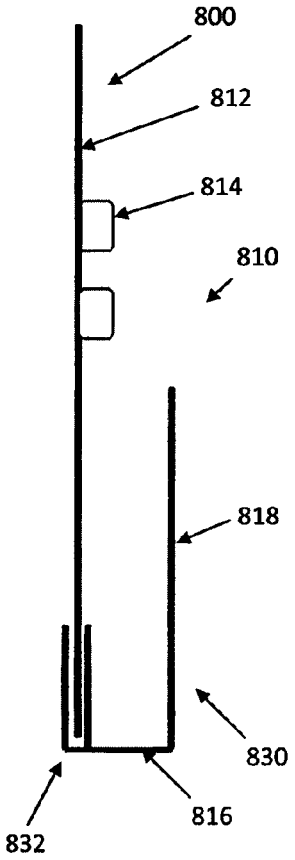
FIG. 20 depicts another embodiment of a blister pack cartridge.
Figure 21:
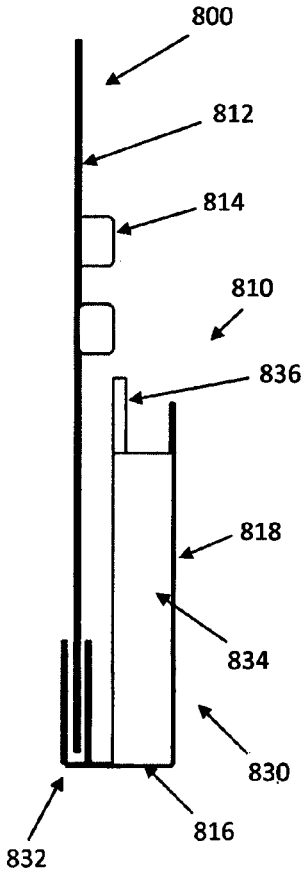
FIG. 21 depicts another embodiment of a blister pack cartridge.

FIGS. 20 and 21 depict an alternative embodiment, in which a blister pack cartridge 810 is provided as an assembly of a standard blister pack 800 and a blister pack attachment 830. The standard blister pack 800 comprises a backing sheet 812 and a plurality of blister compartments 814. The blister pack attachment 830 comprises a connector 832, a base member 816 and a spacer member 818. The connector 832 is adapted to receive and retain an end of the standard blister pack 800 by interference fit, thereby attaching the blister pack attachment 830 to the standard blister pack 800 and forming a blister pack cartridge 810. Once assembled, the blister pack cartridge 810 can be used in the same way as described above in relation to the blister pack cartridge 710 of FIG. 18.

The connector 832 can be in the form of a pair of resilient, opposing clamp members that are adapted to clamp onto one end of the backing sheet 812 in the same manner as depicted in FIG. 17. In the same way, a rib can be provided on the backing sheet 812 to make removal of the blister pack 800 from the connector 832 more difficult.

By providing a blister pack attachment 830, a blister pack cartridge 810 can be assembled from a standard blister pack 800. This avoids the need to manufacture a specific blister pack cartridge 810 as an integral unit and allows the blister pack attachment to be retro-fitted to a standard blister pack 800.

As depicted in FIG. 21, the blister pack cartridge 810 can further include a fluid receptacle 834 provided on the spacer member 818. This allows a small amount of fluid, such as water, to be provided with the blister pack cartridge 810 to enable a user to swallow the contents of the blister compartments 814 with the aid of some water. A straw 836 may be provided to access the fluid receptacle 834.

Figure 22:
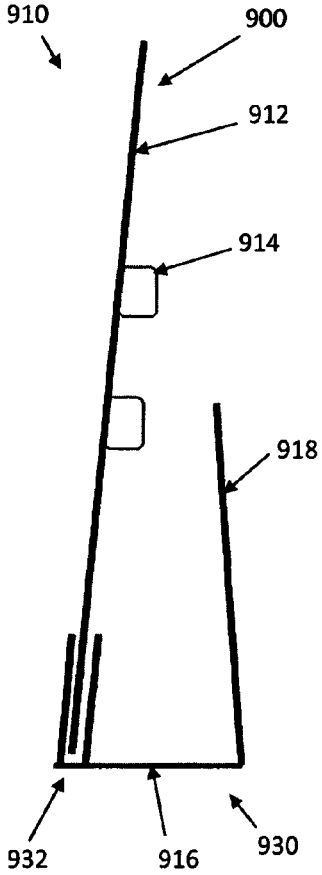
FIG. 22 depicts another embodiment of a blister pack cartridge.

In an alternative embodiment, shown in FIG. 22, a blister pack cartridge 910 is provided as an assembly of a standard blister pack 900 and a blister pack attachment 930. The standard blister pack 900 comprises a backing sheet 912 and a plurality of blister compartments 914. The blister pack attachment 930 comprises a connector 932, a base member 916 and a spacer member 918.

In this embodiment, the blister pack 900, when received in the connector 932 is offset from perpendicular to the base member 916 and the spacer member 918 is also offset from perpendicular to the base member 916. This creates a blister pack cartridge 910 that has a wide base member 916 with the standard blister pack 900 and the spacer member 918 inclined inwardly towards each other as they extend from the base member 916.

The connector 932 can be in the form of a pair of resilient, opposing clamp members that are adapted to clamp onto one end of the backing sheet 912 in the same manner as depicted in FIG. 17. In the same way, a rib can be provided on the backing sheet 912 to make removal of the blister pack 900 from the connector 932 more difficult.

Figure 23:
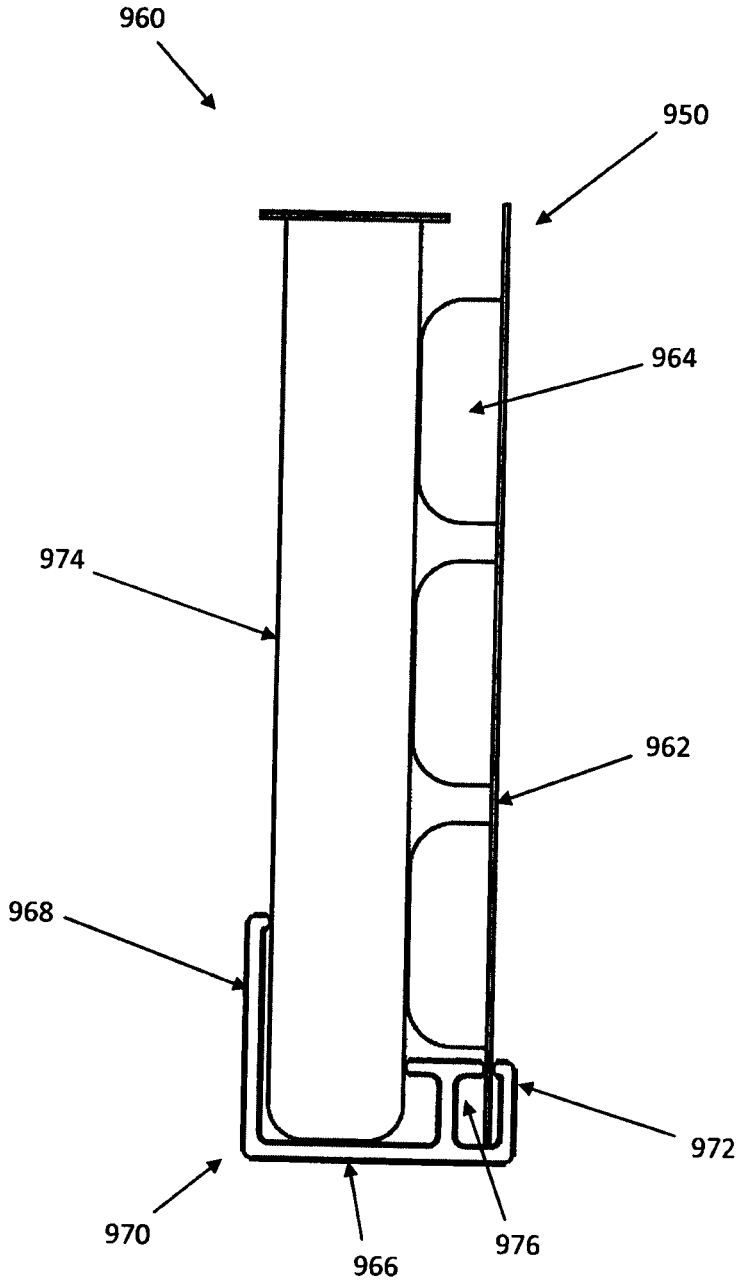
FIG. 23 depicts another embodiment of a blister pack cartridge.

In an alternative embodiment, shown in FIG. 23, a blister pack assembly 960 is provided as an assembly of a standard blister pack 950, a fluid receptacle 974 and an attachment device 970. The standard blister pack 950 comprises a backing sheet 962 and a plurality of blister compartments 964. The attachment device 970 comprises a base member 966, a support member 968, an intermediate T-shaped member 976 and a clamp member 972.

In this embodiment, an end of the blister pack 950 is clamped between the intermediate T-shaped member 976 and the clamp member 972. The fluid receptacle 974 is arranged with its base supported between the support member 968 and the intermediate T-shaped member 976. This creates a compact blister pack assembly 960 that securely holds a blister pack 950 and a fluid receptacle 974.

In use, the blister pack assembly 960 is adapted to fit between the spirals of a spiral vending machine. The flat base member 966 allows the blister pack assembly to sit upright and slide as it is moved forward by the spiral vending machine. Once purchased, the user simply removes the medicaments from the blister pack 950 opens the fluid receptacle 974 and drinks the contents to assist in swallowing the medicaments.

Although the invention has been described with reference to specific examples, it will be appreciated by those skilled in the art that the invention may be embodied in many other forms.

The invention claimed is:

1. A medicament dispensing device comprising:

a first compartment for receiving and dispensing a corresponding first type of medicament package, the first compartment having a first peripheral wall that is generally rectangular in cross-section and a first key block arranged within the first compartment, the first peripheral wall and the first key block defining a first internal configuration;

a second compartment for receiving and dispensing a corresponding second type of medicament package, the second compartment having a second peripheral wall that is generally rectangular in cross-section and a second key block arranged within the second compartment, the second peripheral wall and the second key block defining a second internal configuration that differs from the first internal configuration; and at least one opening accessible by a consumer and adapted to allow the consumer to retrieve a medicament package dispensed from one of the compartments;

wherein the first type of medicament package has a generally rectangular base sized to be received in the first compartment, the first type of medicament package having a cutout corresponding in shape and position to the first key block, such that the first type of medicament package can be received in the first compartment; and wherein the second type of medicament package has a generally rectangular base sized to be received in the second compartment, the second type of medicament package having a cutout corresponding in shape and position to the second key block, such that the second type of medicament package can be received in the second compartment but not in the first compartment.

2. The medicament dispensing device of claim 1, wherein the key blocks are removable and wherein a plurality of said key blocks form a key block system, the key block system comprising:

a plurality of slots provided on the peripheral wall of each compartment; and tabs provided on each key block, each tab being configured to be received in any one of the slots, enabling the key blocks to be arranged in various positions around the peripheral wall.

3. The medicament dispensing device of claim 2, wherein the slots are provided in an insert arranged against the peripheral wall.

4. The medicament dispensing device of claim 1, wherein the slots and tabs are T-shaped in cross-section.

5. The medicament dispensing device of claim 1, wherein the medicament packages are blister packs enclosed in a box.

6. The medicament dispensing device of claim 1, wherein the medicament packages are blister packs secured to a base panel.

7. A medicament dispensing device comprising:

a first compartment for receiving a corresponding first type of dispenser cartridge containing a plurality of medicament packages, the first compartment having a first peripheral wall that is generally rectangular in cross-section and a first key block arranged within the first compartment, the first peripheral wall and the first key block defining a first internal configuration;

a second compartment for receiving a corresponding second type of dispenser cartridge containing a plurality of medicament packages, the second compartment having a second peripheral wall that is generally rectangular in cross-section and a second key block arranged within the second compartment, the second peripheral wall and the second key block defining a second internal configuration that differs from the first internal configuration; and at least one opening accessible by a consumer and adapted to allow the consumer to retrieve a medicament package dispensed from one of the dispenser cartridges;

wherein the first type of dispenser cartridge has a generally rectangular base sized to be received in the first compartment, the base of the first type of dispenser cartridge having a cutout corresponding in shape and position to the first key block, such that the first type of dispenser cartridge can be received in the first compartment; and wherein the second type of dispenser cartridge has a generally rectangular base sized to be received in the second compartment, the base of the second type of dispenser cartridge having a cutout corresponding in shape and position to the second key block, such that the second type of dispenser cartridge can be received in the second compartment but not in the first compartment.

8. The medicament dispensing device of claim 7, wherein the key blocks are removable and wherein a plurality of said key blocks form a key block system, the key block system comprising:

a plurality of slots provided on the peripheral wall of each compartment; and tabs provided on each key block, each tab being configured to be received in any one of the slots, enabling the key blocks to be arranged in various positions around the peripheral wall.

9. The medicament dispensing device of claim 8, wherein the slots are provided in an insert arranged against the peripheral wall.

10. The medicament dispensing device of claim 8, wherein the slots and tabs are T-shaped in cross-section.

11. The medicament dispensing device of claim 7, further comprising an electronic information display screen on the front of the medicament dispensing device.

12. The medicament dispensing device of claim 1, further comprising an electronic information display screen on the front of the medicament dispensing device.

* * * * *